United States Patent [19]

Ito et al.

[11] 4,330,489

[45] May 18, 1982

[54] VARIABLE VENTURI TYPE CARBURETOR

[76] Inventors: Takaaki Ito, 527 Imasato, Susono-shi, Shizuoka-ken; Norihiko Nakamura, 3-8-14 Fuyodai, Mishima-shi, Shizuoka-ken, both of Japan

[21] Appl. No.: 233,161

[22] Filed: Feb. 10, 1981

Related U.S. Application Data

[62] Division of Ser. No. 72,996, Sep. 6, 1979, Pat. No. 4,289,715.

[30] Foreign Application Priority Data

Sep. 11, 1978 [JP] Japan ..... 53-111435

[51] Int. Cl.[3] ..... F02M 9/06

[52] U.S. Cl. ..... 261/44 C

[58] Field of Search ..... 261/44 B, 44 C, 44 F

[56] References Cited

U.S. PATENT DOCUMENTS

| | | | |
|---|---|---|---|
| 2,118,038 | 5/1938 | Brodersen et al. | 261/50 A |
| 2,240,497 | 5/1941 | Dunn | 261/50 A |
| 3,684,257 | 8/1972 | Lawrence | 261/44 C |
| 3,689,036 | 9/1972 | Kikuchi et al. | 261/44 C |
| 3,695,589 | 10/1972 | Lamore | 261/50 A |
| 3,753,555 | 8/1973 | Lawrence | 261/44 C |
| 3,875,917 | 4/1975 | Scarritt, Sr. | 261/44 C |
| 4,136,139 | 1/1979 | Nakamura et al. | 261/44 C |
| 4,153,653 | 5/1979 | Moore | 261/50 A |

FOREIGN PATENT DOCUMENTS

| | | | |
|---|---|---|---|
| 2202688 | 6/1973 | Fed. Rep. of Germany | 261/44 C |
| 52-14133 | 2/1977 | Japan | 261/44 F |
| 52-47140 | 4/1977 | Japan | 261/44 F |
| 16755 | 11/1916 | United Kingdom | 261/44 B |
| 488462 | 7/1938 | United Kingdom | 261/44 B |

*Primary Examiner*—Tim R. Miles

*Attorney, Agent, or Firm*—Oblon, Fisher, Spivak, McClelland & Maier

[57] ABSTRACT

Variable venturi type carburetor characterized in that one end of the fuel suction-ejection hole opens in a venturi unit formed in the carburetor body; a throttle is provided midway in the fuel suction-ejection hole; one end of a fuel path, the other end of which opens in the float chamber, opens in the inside wall of the throttle, whereby steam bubbles generated in the fuel of the fuel path can be sucked into said throttle and thus coalescence and growth of steam bubbles in the fuel can be prevented from causing vapor lock.

7 Claims, 6 Drawing Figures

VARIABLE VENTURI TYPE CARBURETOR

This is a division of application Ser. No. 072,996, filed Sept. 6, 1979 now U.S. Pat. No. 4,289,715.

BACKGROUND OF THE INVENTION (1) Field of the Invention

The present invention relates to a variable venturi type carburetor.

(2) Description of the Prior Art

In the conventional variable venturi type carburetor, for instance in a horizontal needle venturi type carburetor, as illustrated in FIG. 1, the throttle 3 is provided in one part of the horizontal fuel suction-ejection hole assembly 2, one end of which opens in the venturi unit 1; a tapered needle 5 running through the throttle 3 is provided in the suction piston 4 which is located opposite to the fuel suction-ejection hole 2 and can come into or out of the venturi unit 1; and the effective cross-sectional area of a gap formed between said needle 5 and said throttle 3 is utilized to gauge the fuel volume to be sucked or ejected. The suction piston 4, which moves in accordance with the sucked volume of air in the suction system, serves to keep the negative venturi pressure nearly constant.

In the conventional carburetor of this type, however, the top end of the fuel path 7, the bottom end of which opens in the float chamber 6, opens into the fuel suction hole 2 upstream of the throttle 3. Therefore, when idling continues under high temperature, steam bubbles 8 generated in the fuel collect in the fuel suction-ejection hole 2 and they coalesce and collect to block the throttle 3, with the result that the mixture becomes steadily lean. Further, the mixture becomes suddenly lean with passage of steam bubbles through the throttle 3, which is liable to cause hunting of the air/fuel ratio as indicated in the characteristic curve A of FIG. 2. As a consequence the engine is liable to lose stability in idling, and in the worst cases, it may come to a stall.

SUMMARY OF THE INVENTION

The primary object of the present invention is to provide a variable venturi type carburetor which can prevent the engine from knocking or stalling by releasing the steam bubbles in the fuel into the venturi unit without permitting their coalescence and growth within the fuel suction-ejection hole, and thereby stabilizing the air/fuel ratio.

Another object of the present invention is to provide an variable venturi type carburetor with an enhanced ability of sucking out the steam bubbles in the fuel of the fuel path through the construction that one end of the fuel path, the other end of which opens in the float chamber, opens in the throttle where the flow path area is the least and the fuel flow velocity is the fastest, in the fuel suction-ejection hole.

Still aother object of the present invention is to provide a variable venturi type carburetor with a high ability of sucking out the steam bubbles in the fuel of the fuel path through the construction wherein the fuel path with a plurality of holes opens in the throttle.

Other objects of the present invention will become apparent from a reading of the following detailed explanation about its preferred embodiments.

DETAILED EXPLANATION OF PREFERRED EMBODIMENTS

Figure 1:
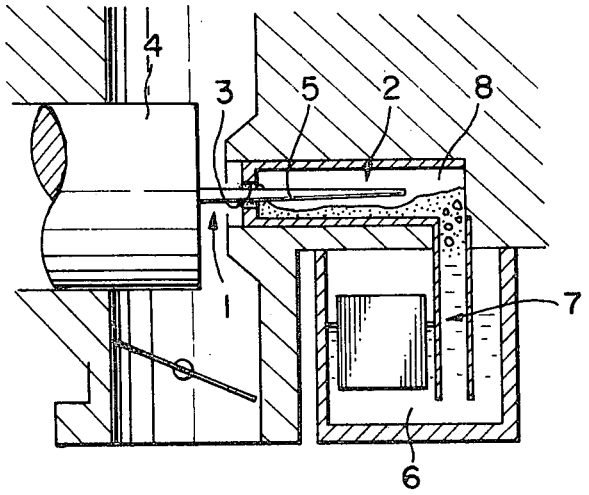
FIG. 1 PRIOR ART
FIG. 1 is a longitudinal section view of the conventional horizontal needle variable venturi type carburetor.

Explanation is to be made here about one application of the present invention to a horizontal needle variable venturi type carburetor, referring to the drawings.

Figure 3:
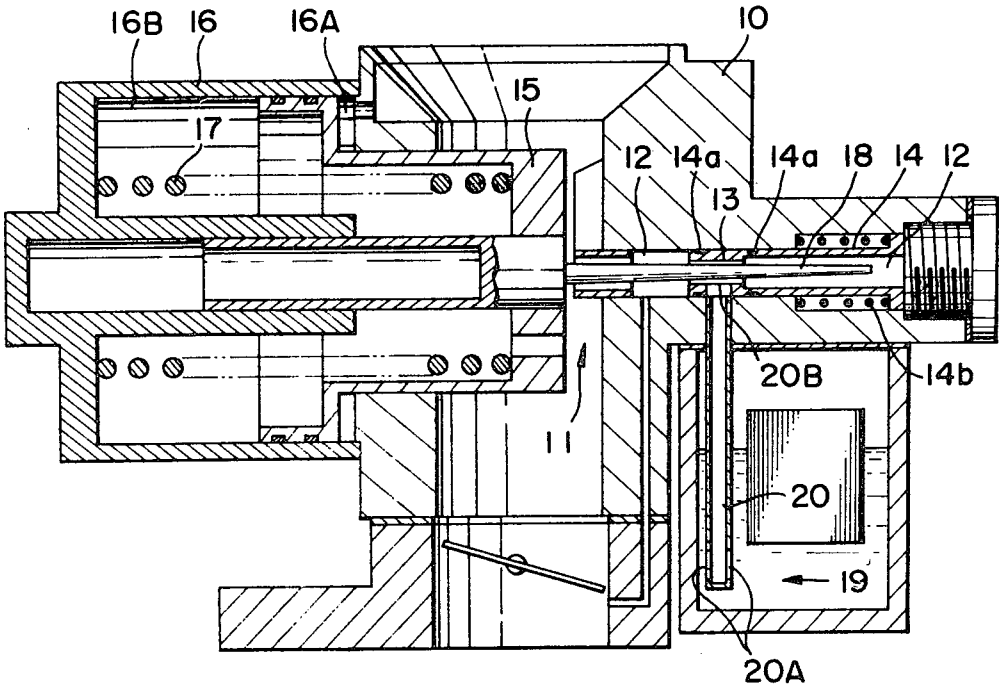
FIG. 3 is a longitudinal section view of a principal part of a horizontal needle variable venturi type carburetor as one embodiment of the present invention.

In FIG. 3 illustrating one embodiment of the present invention, reference number 10 is the carburetor body, 11 is the venturi unit, 12 is the fuel suction-ejection hole, one end of which opens in the venturi unit 11, and 13 is a throttle provided in one part of the fuel suction-ejection hole 12.

Throttle 13 is formed in a tubular member 14 inserted into the body 10. Reference number **14*a* is an O-ring, 14*b* is a compressive spring, and 15 is a suction piston located opposite to the fuel suction-ejection hole 12, which can be moved into or out of the venturi unit 11. Piston 15 divides the suction chamber 16 installed outside of the body 10 into the atmospheric chamber 16A and the venturi negative pressure chamber 16B; and the spring 17 urges said piston 15 in the direction of reducing the effective cross sectional area of the venturi unit 11. Thus said piston 15**, which displaces in accordance with the sucked air volume, can keep the negative pressure of the venturi approximately constant.

Reference number 18 is a tapered needle attached to the suction piston 15. Such needle is located inside of the throttle 13 and, by displacing within the throttle 13 interlocking with the piston 15, it measures the fuel volume.

Upon the body 10 beneath the fuel suction-ejection hole 12 is located the float chamber 19. Reference number 20 is a vertical fuel pipe or path to introduce the fuel in the float chamber 19 into the fuel suction-ejection hole 12. The bottom end 20A of said path 20 opens near the base of the float chamber 19, while the top end 20B of it runs through the body 10 and the tubular member 14 and opens into the throttle 13. Path 20 is preferably formed in a narrow pipe of uniform section.

Figure 2:
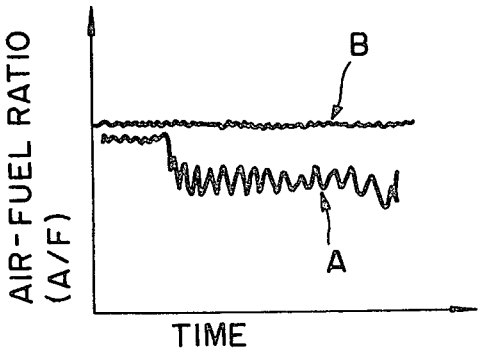
FIG. 2 is a diagram comparing the air/fuel ratio-time curve during idling between the conventional device and the present invention.

In the above-composed variable venturi type carburetor, the fuel in the float chamber 19 goes up the fuel path 20 under the effect of venturi negative pressure; is sucked into the throttle 13 of the fuel suction-ejection hole 12; and, after being gauged at an annular gap formed between the needle 18 and the throttle 13, it is ejected into the venturi unit 11. The annular gap is so narrow that the flow velocity of fuel is increased there. Therefore tiny steam bubbles of fuel generated under high temperatures in the fuel path 20 are sucked into the annular gap. Meanwhile, since there is no dead space between the fuel path 20 and the annular gap, no bubbles can collect midway thereof. Thus, without coalescence and growth the bubbles are sucked through the annular gap into the venturi unit. As a consequence the air/fuel ratio of the mixture supplied to the engine, without hunting or damping, can be maintained nearly constant, as indicated by the characteristic curve B of FIG. 2, thereby ensuring engine stability in idling.

Figure 4:
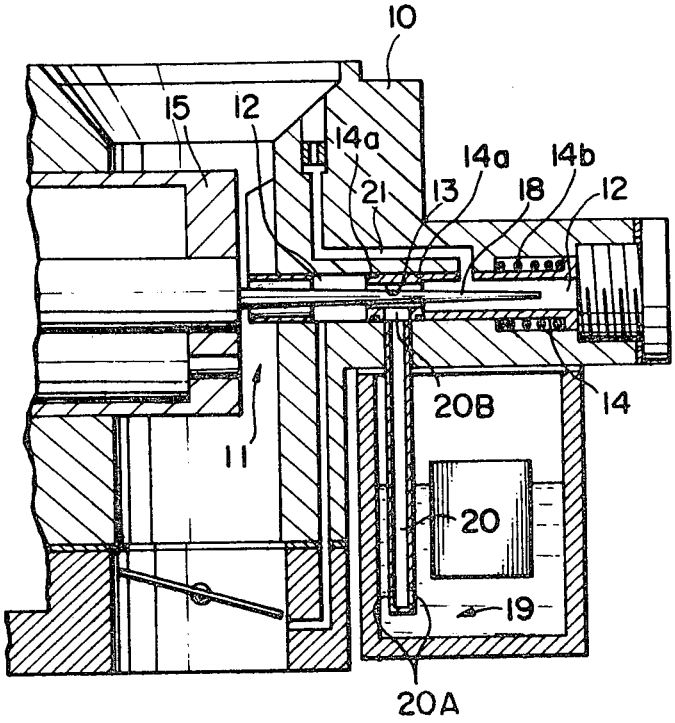
FIGS. 4 to 6 are longitudinal section views of the principal parts of a device as another embodiment of the present invention.

FIG. 4 illustrates another embodiment of the present invention and in FIGS. 4 and 3, like elements are denoted by the same numbers. This embodiment is characterized in that an air bleed path 21 is opened in the fuel suction-ejection hole 12 upstream of the throttle 13. The air introduced through said path 21 into the fuel suction-ejection hole 12 causes a further increase in the fuel flow velocity at the throttle 13, thereby promoting the bubble sucking-ejecting function still more.

Figure 5:
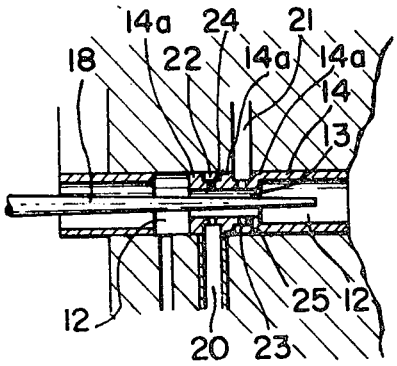

As illustrated in FIG. 5, the present invention may be constituted such that two annular grooves 22, 23 are provided outside of the throttle 13 in the tubular member 14; a plurality of small holes 24, 25 opening into the throttle 13 are provided respectively in said grooves 22, 23, spaced in a peripheral direction; and the fuel path 20 and the air bleed path 21 are opened through said holes 24, 25 into the throttle 13. In this case, as a result of the fuel and the bled air being introduced into the throttle 13 via said plurarity of holes 24, 25, the mixed degree of fuel and bled air is increased, thereby forming a uniform emulsion flow and in consequence causing the steam bubbles in the fuel to be smoothly sucked out together with the fuel.

Figure 6:
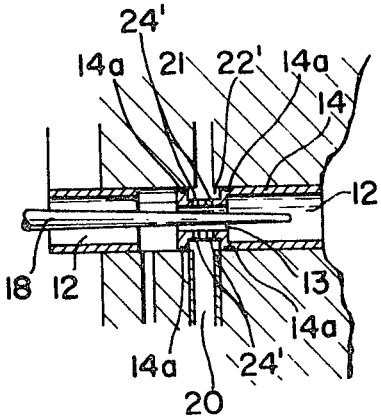

Further the invention may be constituted such, as indicated in FIG. 6, that one annular groove 22' is provided outside of the throttle 13 in the tubular member 14; a plurality of small holes 24' opening into the throttle 13 are provided in said groove 22', spaced in peripheral direction; and via said holes 24', the fuel path 20 and the air bleed path 21 open into the throttle 13. In this case, small bubbles generated in the path 20 are separated from the fuel in the groove 22', and together with the bled air, are sent to the throttle 13.

Although only horizontal variable venturi type carburators are referred to above, it goes without saying that the present invention is applicable with the same functional effect to variable venturi carburetors other than said horizontal needle type, namely, to ones in which the suction path is laid out vertically.

As described above, in the variable venturi type carburator according to the present invention, one end of the fuel path, the other end of which opens in the float chamber, is opened into the throttle where the flow path area is the least and the fuel flow velocity is the fastest, in the fuel suction hole; therefore it is possible to prevent the coalescence and growth of bubbles in the fuel of the fuel path under high temperatures, avoid a lean mixture or hunting due to the coalescence and growth of bubbles, and thus enhance the engine stability in idling with no knocking nor stalling.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. Variable venturi type carburetor having a body including a float chamber comprising:

a venturi unit vertically formed in a carburetor body;

a horizontal fuel suction-ejection hole assembly, one end of which opens into said venturi unit;

a throttle provided inside of and midway of the fuel suction-ejection hole assembly;

a suction piston opposed to the venturi opening end of said fuel suction-ejection hole assembly, movable into or out of said venturi unit;

a tapered needle attached to said suction piston, a tip portion of said needle extending through said throttle;

a fuel suction pipe fitted to the carburetor body beneath said throttle, a bottom portion of said pipe opening into the float chamber and a top portion opening into said fuel suction-ejection hole assembly; and fuel path means formed in the throttle and intersecting with said fuel suction-ejection hole assembly in a substantially orthogonal manner.

2. A variable venturi type carburetor as set forth in claim 1, said body further comprising an external wall having an opening formed therein and a plug member disposed in said wall opening.

3. A variable venturi type carburetor as set forth in claim 1, further comprising a tubular member inserted into said fuel suction hole assembly.

4. A variable venturi type carburetor as set forth in claim 1, wherein said fuel suction pipe is vertically fitted to the carburetor.

5. Variable venturi type carburetor having a body provided with a float chamber comprising:

a venturi unit formed in the carburetor body;

a fuel suction-ejection hole assembly, one end of which opens into said venturi unit;

a throttle provided midway in said fuel suction-ejection hole assembly;

a suction piston opposed to the one end of said fuel suction-ejection hole assembly, movable into or out of said venturi unit;

a needle attached to said suction piston, a tip portion of said needle running through said throttle and extending into said fuel suction-ejection hole assembly; and fuel path means, one end of which opens into the float chamber, the other end opening in the inner peripheral wall of said throttle, said fuel path means intersecting with said fuel suction-ejection hole assembly in a substantially orthogonal manner.

6. Carburetor of claim 5, wherein said fuel suction-ejection hole assembly extends in a horizontal direction and said fuel path means extends in a vertical direction.

7. Carburetor of claim 5 or 6, wherein the fuel path means comprises a single hole formed in said throttle.

* * * * *

UNITED STATES PATENT AND TRADEMARK OFFICE

CERTIFICATE OF CORRECTION

PATENT NO. : 4,330,489

DATED : May 18, 1982

INVENTOR(S) : TAKAAKI ITO ET AL.

It is certified that error appears in the above—identified patent and that said Letters Patent is hereby corrected as shown below:

On The Title Page insert:

-- [73] Assignee: TOYOTA JIDOSHA KOGYO KABUSHIKI KAISHA

Aichi-ken, Japan --.

Signed and Sealed this

*Seventeenth* Day of *August 1982*

[SEAL]

*Attest:*

GERALD J. MOSSINGHOFF

*Attesting Officer*

*Commissioner of Patents and Trademarks*